United States Patent [19]

Helling

[11] Patent Number: 4,712,507

[45] Date of Patent: Dec. 15, 1987

[54] APPARATUS FOR THE APPLICATION OF A PRIMER TO A PLASTIC PROFILE OR THE LIKE

[76] Inventor: Wilhelm Helling, Schluchtweg 6, 4517 Hilter 1, Fed. Rep. of Germany

[21] Appl. No.: 833,980

[22] Filed: Feb. 27, 1986

[30] Foreign Application Priority Data

Feb. 28, 1985 [DE] Fed. Rep. of Germany ..... 3507104

[51] Int. Cl.[4] ..... B05C 1/06

[52] U.S. Cl. ..... 118/208; 118/264; 118/267

[58] Field of Search ..... 118/264, 267, 208, DIG. 18

[56] References Cited

U.S. PATENT DOCUMENTS 759,801 5/1904 Bone ..... 118/DIG. 18

2,120,110 6/1938 Morrell ..... 118/DIG. 18

3,874,332 4/1975 Meinel ..... 118/264

4,413,585 11/1983 Weinhold et al. ..... 118/DIG. 18

*Primary Examiner*—Shrive P. Beck

*Attorney, Agent, or Firm*—Hill, Van Santen, Steadman & Simpson

[57] ABSTRACT

Apparatus for the application of a primer to a plastic profile or the like, characterized by a vat comprising sealing elements provided with clearances for the passage of the plastic profile, accepting a fibrous web material (8) to be saturated with the primer to be applied, and provided with means (6,7) for saturating the fibrous web material (8) with the primer, with means for pressing the fibrous web material against the plastic profile, and with an outlet opening (2).

8 Claims, 2 Drawing Figures

APPARATUS FOR THE APPLICATION OF A PRIMER TO A PLASTIC PROFILE OR THE LIKE

BACKGROUND OF THE INVENTION

The invention relates to an apparatus for the application of a primer to a plastic profile or the like.

When coating plastic profiles or the like whereby, for example, a primer is first applied to the profile and then a foil is applied thereto, it has proven advantageous to apply the foil immediately after the extruding of the plastic profile, so that cleaning the extruded plastic profile of dust or the like such as would be otherwise required is not required.

It has already been proposed to provide spray guns for this purpose, the primer being sprayed onto the extruded plastic profile with their assistance. It has turned out, however, that, given the multitude of shapes and contours of the profiles to be covered, the set-up of the spray guns for applying the primer as well as the monitoring of the spray pattern, this latter being defined by the spraying pressure, spraying air and nozzle spacing from the profile surface, can be extremely involved given complicated profiles and can only be reproduced with difficulty over a longer production timespan.

The object of the invention is to create an apparatus for the application of a primer to an extruded plastic profile, whereby, given simple set-up, an unchanging primer application to the plastic profile to be subsequently covered with a foil is guaranteed.

SUMMARY OF THE INVENTION

This object is achieved in accord with the invention by means of a vat comprising sealing elements provided with clearances for the passage of the plastic profile, accepting a fibrous web material saturated with the primer to be applied, and provided with means for saturating said fibrous web material with said primer, with means for pressing said fibrous web material against the plastic profile, and with an outlet opening.

It can thereby be provided that the means for pressing the fibrous web material against the plastic profile comprise at least one felt strip or the like which is to be drawn in the direction toward the plastic profile by means of at least one thumb nut conducted on a spindle rod or the like, whereby two pair of felt strips are preferably provided.

The invention further provides that the means for the saturation of the fibrous web material (8) comprise at least one metering gun which supplies primer thereto in excess.

It can also be provided that at least two metering guns arranged between the pairs of felt strips are provided.

A further embodiment of the invention is characterized in that the vat comprises removable walls at its end sides lying perpendicular to the running direction of the plastic profile, these removable walls being respectively formed of two panels or the like having cellular material or the like which is resistant to the primer solution and seals lying therebetween.

It can also be provided in accord with the invention that the panels with the cellular material lying therebetween are respectively both held together by means of threaded rods and thumb nuts as well as, second, tightly connected therewith to the remaining component parts of the vat.

A further embodiment of the invention is characterized by cover plates or the like which are to be inserted into the vat and which shield that part of the plastic profile to which primer is not to be applied.

It can also be provided in accord with the invention that the cover plates are provided with clearances which allow excess primer to flow out.

BRIEF DESCRIPTION OF THE DRAWINGS

Further features and advantages of the invention derive from the claims and from the description in which exemplary embodiments of the apparatus of the invention are set forth with reference to a drawing. Thereby shown are:

DESCRIPTION OF THE PREFERRED EMBODIMENT

Figure 1:
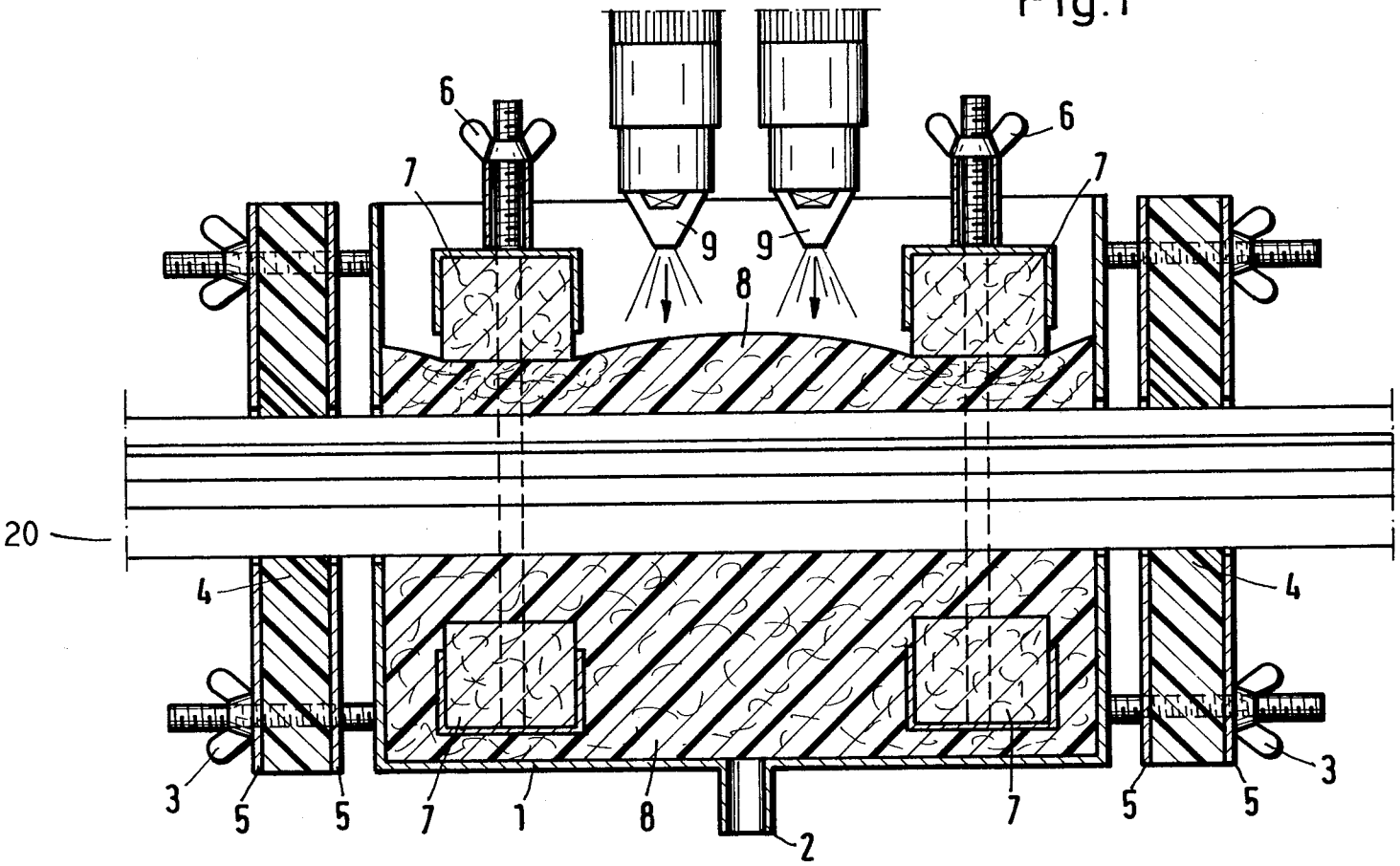
FIG. 1 a longitudinal section through an exemplary embodiment of the apparatus of the invention.

The walls 1 forming the vat are provided with clearance through which the plastic profile 20 to which the primer is to be applied is conducted. Sealing elements are put in place on threaded rods at both sides of the vat, these sealing elements being composed of two plates (5) which enclose a cellular material in sandwich fashion, this cellular material being resistant to the solvent of the primer. These sealing elements can be directly pressed against the wall 1 by means of thumb nuts 3.

The vat accepts a synthetic fibrous web material 8 which is saturated with the primer via metering guns 9. Two pair of felt strips 7 are provided in order to establish the desired contact pressure of the fibrous web material 8 against the plastic profile 20, these felt strips 7 being capable of being moved toward one another by means of a thumb nut 6 conducted on a spindle, whereby the fibrous web material lying between the felt strips 7 and the plastic profile lies against the plastic profile with the pressure respectively desired. The walls 1 of the vat as well as the plates 5 and the fibrous web material 4 of the sealing elements are provided with clearances through which the plastic profile is conducted, whereby the clearances in the walls 1 and in the plates 5 are somewhat larger than the crossection of the profile. The cellular material 4 of the sealing elements, by contrast, lies firmly against the plastic profile so that an emergence of primer is avoided. On the contrary, excess primer remains in the vat and flows off in downward direction through the outlet opening 2 provided therein. Metering guns 9 serve for the introduction of the primer.

Figure 2:
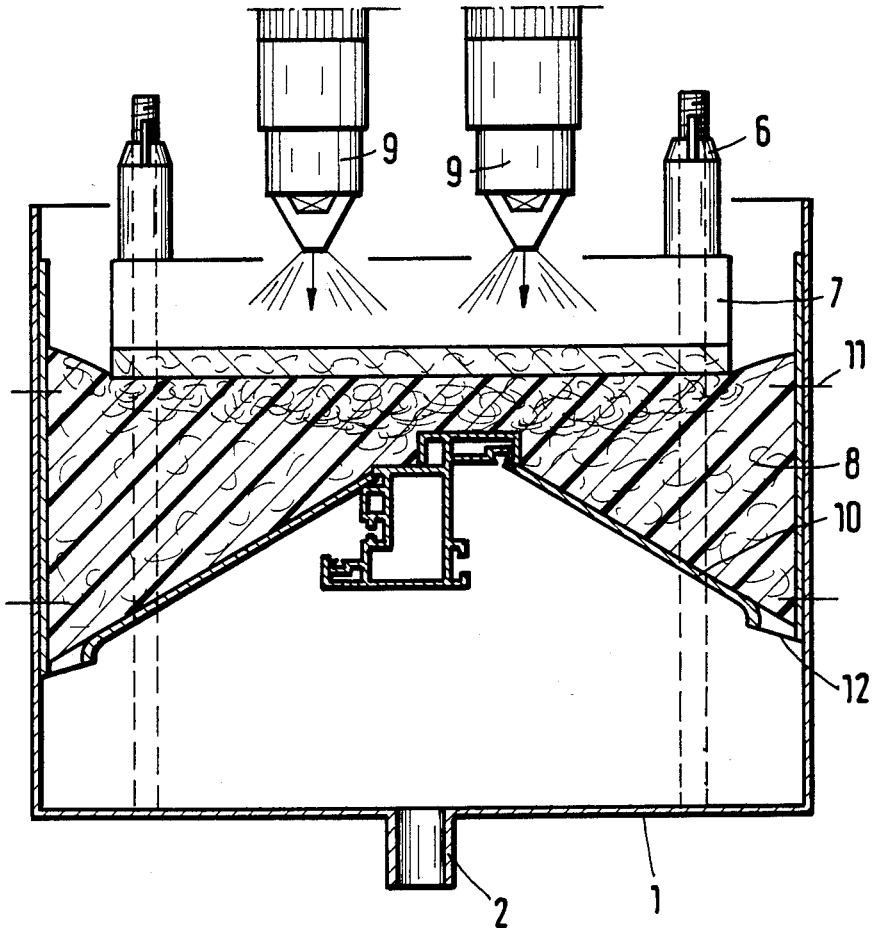
FIG. 2 a crossection through another exemplary embodiment comprising cover plates.

Separate cover panels 10 of a special steel which can be adjusted in oblong holes 11 in the wall 1 of the vat are provided given the embodiment shown in FIG. 2. These cover panels 10 comprise further clearances which allow an outflow of the excess primer in the direction of the outlet opening 2.

The proposed apparatus for the application of primer to extruded plastic profiles assures a constant application of primer to the profile surface which is to be subsequently covered, assuring this without a time-consuming set-up being previously required. Over and above this, the cover plates further provided make it possible to guarantee that primer is applied to only a part of the surface of the plastic profile.

The cellular material 4 which sees to the sealing of the vat is advantageously composed of a polyethylene, whereby good compressibility and good restoring capability are to be taken into consideration.

The proposed arrangement assures a simple visual monitoring, a reliable, uniform wetting of all profile surfaces to be covered and avoids the formation of spray mists as would otherwise arise given jet-application of the primer solution by means of spray guns.

The features of the invention set forth in the above description, in the drawing as well as in the claims can be essential for the realization of the invention in its various embodiments, being essential thereto both individually as well as in arbitrary combinations.

List of Reference Characters

1 Wall
2 Outlet opening
3 Thumb nut
4 Cellular material
5 Panel
6 Thumb nut
7 Felt strip
8 Fiber material
9 Metering gun
10 Cover plate
11 Oblong hole
12 Clearance

I claim:

1. An apparatus for the application of a primer to a plastic profile or the like, characterized by a vat comprising: sealing elements provided with clearances for the passage of the plastic profile, a fibrous web material (8) in said vat and saturated with the primer to be applied, means (6, 7) for saturating the fibrous web material (8) with the primer, means for pressing the fibrous web material against the plastic profile and means defining an outlet opening (2), said vat having end faces and removable walls at said end faces lying perpendicular to the running direction of the plastic profile, each of said removable walls being formed of two spaced panels (5) having sealing cellular material (4) which is resistant to the primer solution lying therebetween, wherein the panels (5) with which the cellular material (4) lying therebetween are secured by threaded fastener means (3) and secured with said fastener means to the vat.

2. An apparatus according to claim 1, characterized in that the means for pressing the fibrous material (8) against the plastic profile comprise at least one felt strip (7) which is to be urged in the direction of the plastic profile by means of at least one thumb nut (6) mounted on a spindle rod.

3. An apparatus according to claim 2, characterized in that two pair of felt strips (7) are provided.

4. An apparatus according to claim 1, characterized in that the means for saturating the fibrous web material (8) comprises at least one metering gun (9) supplying primer thereto in excess.

5. An apparatus according to claim 4, characterized in that said fibrous web material comprises a pair of felt strips and at least two metering guns (9) are arranged between the pairs of felt strips (8).

6. An apparatus according to claim 1, characterized in that the vat comprises removable walls at its end faces lying perpendicular to the running direction of the plastic profile, each of said removable walls being formed of two spaced panels (5) having sealing cellular material (4) which is resistant to the primer solution lying therebetween.

7. An apparatus according to claim 1, characterized by there being further provided cover plates (10) for introduction into the vat which shield a portion of the plastic profile on which the primer is not to be applied.

8. An apparatus according to claim 7, characterized in that the cover plate (10) are provided with clearances (12) which allow excess primer to flow off.

* * * * *